US005228297A

United States Patent [19]

Olson, Jr. et al.

[11] Patent Number: 5,228,297

[45] Date of Patent: Jul. 20, 1993

[54] CRYOGENIC RECTIFICATION SYSTEM WITH DUAL HEAT PUMP

[75] Inventors: Raymond R. Olson, Jr., Williamsville; Theodore F. Fisher, Amherst, both of N.Y.

[73] Assignee: Praxair Technology, Inc., Danbury, Conn.

[21] Appl. No.: 872,157

[22] Filed: Apr. 22, 1992

[51] Int. Cl.[5] ..... F25J 3/02

[52] U.S. Cl. ..... 62/25; 62/30; 62/39; 62/41

[58] Field of Search ..... 62/24, 30, 41, 25, 39

[56] References Cited

U.S. PATENT DOCUMENTS

| | | | |
|---|---|---|---|
| 4,099,945 | 7/1978 | Skolude | 62/30 |
| 4,303,428 | 12/1981 | Vandenbussche | 62/13 |
| 4,345,925 | 8/1982 | Cheung | 62/13 |
| 4,372,764 | 2/1983 | Theobald | 62/41 |
| 4,400,188 | 8/1983 | Patel et al. | 62/13 |
| 4,560,398 | 12/1985 | Beddome et al. | 62/29 |
| 4,662,916 | 5/1987 | Agrawal et al. | 62/13 |
| 4,695,349 | 9/1987 | Becker et al. | 203/26 |
| 4,962,646 | 10/1990 | Rathbone | 62/24 |
| 4,987,744 | 1/1991 | Handley et al. | 62/24 |
| 5,036,672 | 8/1991 | Rottmann | 62/24 |
| 5,098,456 | 3/1992 | Dray et al. | 62/24 |
| 5,152,149 | 10/1992 | Mostello et al. | 62/41 |

*Primary Examiner*—Ronald C. Capossela
*Attorney, Agent, or Firm*—Stanley Ktorides

[57] ABSTRACT

A cryogenic air separation system wherein high pressure oxygen is transition-warmed against both transition-cooling feed air and transition-cooling nitrogen, supplying added reflux for the air separation and enabling column operation at higher pressures without degraded recovery.

9 Claims, 2 Drawing Sheets

CRYOGENIC RECTIFICATION SYSTEM WITH DUAL HEAT PUMP

TECHNICAL FIELD

This invention relates generally to the cryogenic rectification of mixtures comprising oxygen and nitrogen, e.g. air, and more particularly to such cryogenic rectification to produce high pressure product gas.

BACKGROUND ART

The demand for high pressure oxygen gas is increasing due to the greater use of high pressure oxygen in partial oxidation processes such as coal gasification for power generation, hydrogen production, and steelmaking. Often nitrogen is also employed in these processes.

Oxygen gas is produced commercially in large quantities generally by the cryogenic rectification of air. One way of producing the oxygen gas at high pressure is to compress the product oxygen gas from the cryogenic rectification plant. This, however, is costly both in terms of the capital costs for the product oxygen compressor and also in terms of the operating costs to power the product oxygen compressor. Another way of producing high pressure oxygen gas is to operate the cryogenic rectification plant at a higher pressure thus producing the oxygen at a higher initial pressure and reducing or eliminating downstream compression requirements. Unfortunately, operating the cryogenic rectification plant at a higher pressure reduces the efficiency of the production process because component separation depends on the relative volatilities of the components which decrease with increasing pressure. This is particularly the case when high pressure nitrogen product is also desired from the cryogenic rectification plant because the removal of nitrogen from the high pressure distillation column as product reduces the amount of reflux which may be employed thus reducing oxygen recovery.

Accordingly, it is an object of this invention to provide a cryogenic rectification system which can produce high pressure product gas with improved efficiency over results attainable with conventional systems, particularly if both oxygen and high pressure nitrogen product gas is desired.

SUMMARY OF THE INVENTION

The above and other objects which will become apparent to one skilled in the art upon a reading of this disclosure are attained by the present invention, one aspect of which is:

A cryogenic rectification method for producing high pressure product comprising:

(A) transition-cooling at least one elevated pressure feed air stream which may be at a supercritical pressure and passing the resulting feed air fluid into a high pressure column;

(B) separating feed air in the high pressure column by cryogenic rectification into a first nitrogen-rich fluid and into oxygen-enriched fluid;

(C) passing first nitrogen-rich fluid and oxygen-enriched fluid into a lower pressure column and separating them therein by cryogenic rectification into a second nitrogen-rich fluid and into oxygen-rich fluid;

(D) withdrawing second nitrogen-rich fluid from the lower pressure column, compressing at least some of the second nitrogen-rich fluid to a pressure which may be supercritical, transition-cooling the compressed second nitrogen-rich fluid and passing the resulting second nitrogen-rich fluid into the high pressure column; and (E) withdrawing oxygen-rich fluid from the lower pressure column, pumping the oxygen-rich fluid to a higher pressure which may be supercritical, transition-warming the pumped oxygen-rich fluid by indirect heat exchange with the transition-cooling elevated pressure feed air and the transition-cooling compressed second nitrogen-rich fluid, and recovering resulting transition-warmed fluid as high pressure product oxygen.

Another aspect of the invention is:

A cryogenic rectification apparatus for producing high pressure product comprising:

(A) a feed air compressor, a heat exchanger, a first column, and means for passing feed air from the feed air compressor to the heat exchanger and from the heat exchanger to the first column;

(B) a second column and means for passing fluid from the first column to the second column;

(C) a nitrogen compressor, means for passing fluid from the second column to the nitrogen compressor, from the nitrogen compressor to the heat exchanger, and from the heat exchanger to the first column;

(D) a pump, means for passing fluid from the second column to the pump and from the pump to the heat exchanger; and (E) means for recovering fluid from the heat exchanger.

As used herein, the term "indirect heat exchange" means the bringing of two fluid streams into heat exchange relation without any physical contact or intermixing of the fluids with each other.

As used herein, the term "transition-warming" means either the warming of a fluid which results in its vaporization from the liquid state to the vapor state, or the warming of a fluid at a pressure which is above its critical pressure through a range of temperatures which includes its critical temperature.

As used herein, the term "transition-cooling" means either the cooling of a fluid which results in its condensation from the vapor state to the liquid state, or the cooling of a fluid at a pressure which is above its critical pressure from an initial temperature which is at least 1.2 times its critical temperature to a final temperature which is within the range of from 0.5 to 1.1 times its critical temperature.

As used herein, the term "feed air" means a mixture comprising primarily nitrogen and oxygen such as air.

As used herein, the term "compressor" means a device for increasing the pressure of a gas.

As used herein, the term "expander" means a device used for extracting work out of a compressed gas by decreasing its pressure.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150 degrees K.

As used herein, the terms "upper portion" and "lower portion" mean those sections of a column respectively above and below the midpoint of a column.

DETAILED DESCRIPTION

Figure 1:
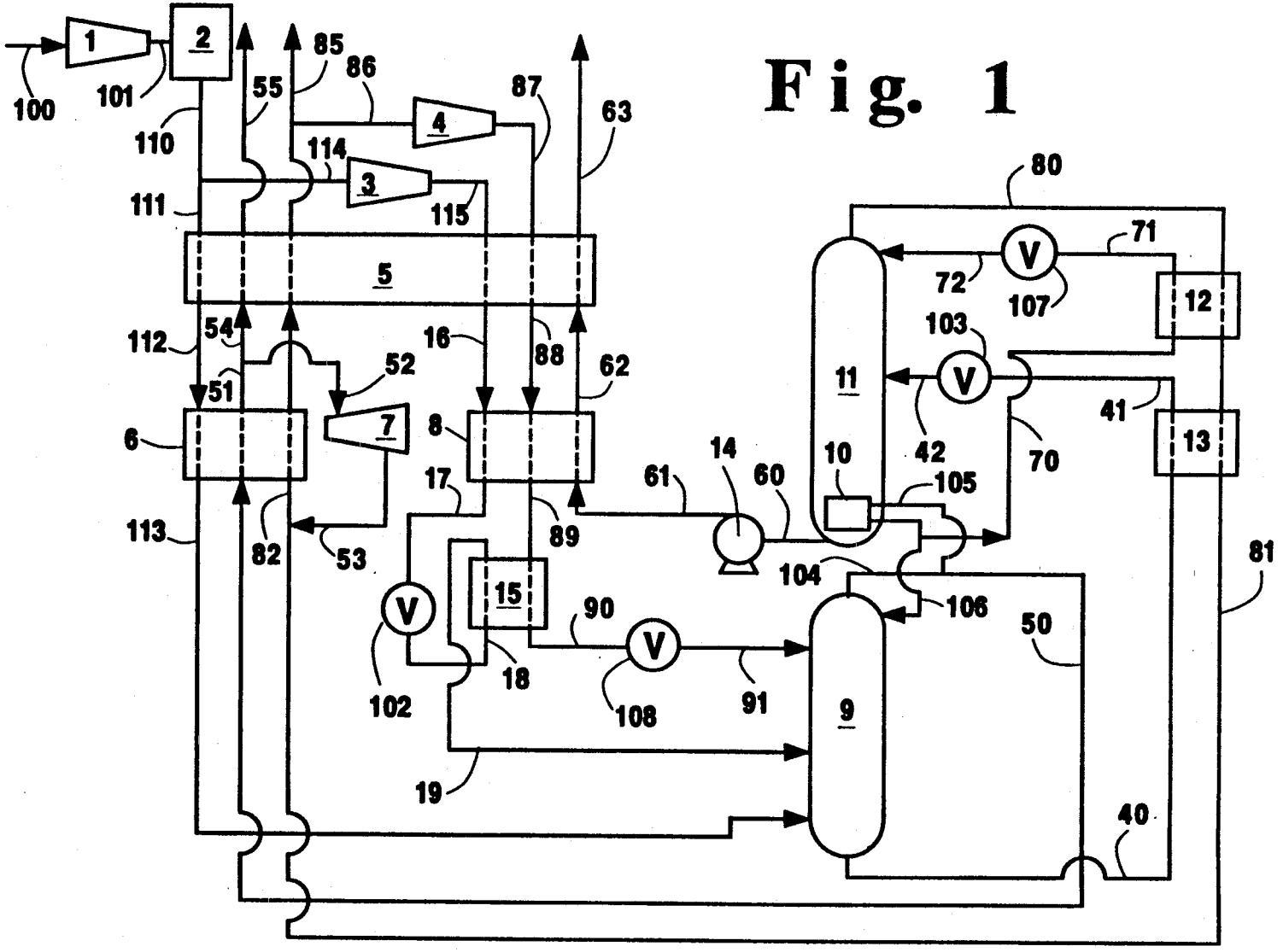
FIG. 1 is a schematic representation of one preferred embodiment of the cryogenic rectification system of the invention.

The invention comprises, in general, a dual heat pump arrangement wherein high pressure pumped oxygen, which may be at a pressure higher than its critical pressure, is transition-warmed against both transition-cooling feed air and transition-cooling nitrogen. Preferably the transition-cooling feed air flow comprises from 25 to 75 percent of the transition-cooling fluid flow in heat exchange with the transition-warming oxygen. If only feed air were used to transition-warm all the oxygen product, the oxygen recovery would be poor. If only nitrogen were used to transition-warm all the oxygen product, the resulting large flow of nitrogen reflux would exceed the reflux requirements needed to offset the poor recovery and, furthermore, the requisite nitrogen compression would consume a large amount of power. To optimize the system, at least some of the feed air is transition-cooled at a temperature compatible with the transition-cooled nitrogen temperature. The transition-cooling of this feed air, in combination with the transition-cooling of the nitrogen, provides the heat duty required to transition-warm the product oxygen to the desired pressure. The split between the feed air and the nitrogen flows against the transition-warming oxygen can be varied and optimized, balancing the lower pressure ratio feed air compressor power against the higher pressure ratio nitrogen compressor power and the baseload air compressor or return nitrogen compressor power, if employed.

The invention will be described in detail with reference to the Drawing. Referring now to the Figure, feed air 100 is compressed by passage through base load air compressor 1 to a pressure within the range of from 60 to 450 pounds per square inch absolute (psia), preferably within the range of from 120 to 450 psia. Compressed feed air 101 is then passed through purification system 2 for the removal of high boiling impurities such as water vapor, carbon dioxide and hydrocarbons to produce cleaned feed air 10. A portion 14 comprising from 10 to 50 percent of the feed air, is compressed to an elevated pressure within the range of from 120 to 3000 psia, preferably within the range of from 140 to 2000 psia, by passage through feed air compressor 3. The resulting elevated pressure feed air 15 is cooled by indirect heat exchange in heat exchanger 5 against return streams and resulting cooled elevated pressure feed air 16 is transition-cooled by passage through heat exchanger 8. The resulting cooled feed air is passed into column 9. The embodiment illustrated in the Figure is a particularly preferred embodiment wherein transition-cooled feed air 17 from heat exchanger 8 is flashed through valve 102 to the pressure of column 9 and warmed by passage through subcooler 15. Resulting warmed feed air 19 is then passed into column 9.

Another portion 11 of cleaned feed air 10 is cooled by passage through heat exchanger 5, resulting stream 12 further cooled by passage through heat exchanger 6 and resulting cooled, clean feed air 13 passed into column 9. Those skilled in the art will recognize that heat exchangers 6 and 8 can alternatively be combined into a single heat exchanger.

First column or high pressure column 9 is operating at a pressure within the range of from 60 to 450 psia. Within high pressure column 9 the feed air is separated by cryogenic rectification into a first nitrogen-rich fluid and into oxygen-enriched fluid. Oxygen-enriched fluid is taken as liquid from the lower portion of column 9 as stream 40 and cooled by passage through heat exchanger 13. Resulting stream 41 is passed through valve 103 and then as stream 42 passed into column 11. First nitrogen-rich fluid is taken as vapor from the upper portion of column 9 as stream 104. A portion 105 of the first nitrogen-rich vapor is condensed in main condenser 10 by indirect heat exchange with boiling column 11 bottoms. A first portion 106 of the resulting condensed nitrogen-rich fluid is passed back into column 9 as reflux. A second portion 70 of the resulting condensed nitrogen-rich fluid is cooled by passage through heat exchanger 12. Resulting nitrogen-rich fluid 71 is passed through valve 107 and then as stream 72 passed into column 11.

Second column or lower pressure column 11 is operating at a pressure less than that of column 9 and within the range of from 30 to 110 psia. Within lower pressure column 11 the feeds are separated by cryogenic rectification into a second nitrogen-rich fluid and into oxygen-rich fluid. Second nitrogen-rich fluid is withdrawn as vapor stream 80 from the upper portion of column 11 and is warmed by passage through heat exchangers 12 and 13 by indirect heat exchange with first nitrogen-rich fluid and with oxygen-enriched fluid, respectively. Resulting second nitrogen-rich stream 81 is further warmed by passage through heat exchangers 6 and 5 and removed from the system as stream 85 which may be recovered as product nitrogen gas having a purity generally of at least 95 percent and preferably of at least 99 percent. A portion 86 of stream 81 taken from the upper portion of lower pressure or second column 11 is passed to nitrogen compressor 4 as will be more fully described later.

Figure 2:
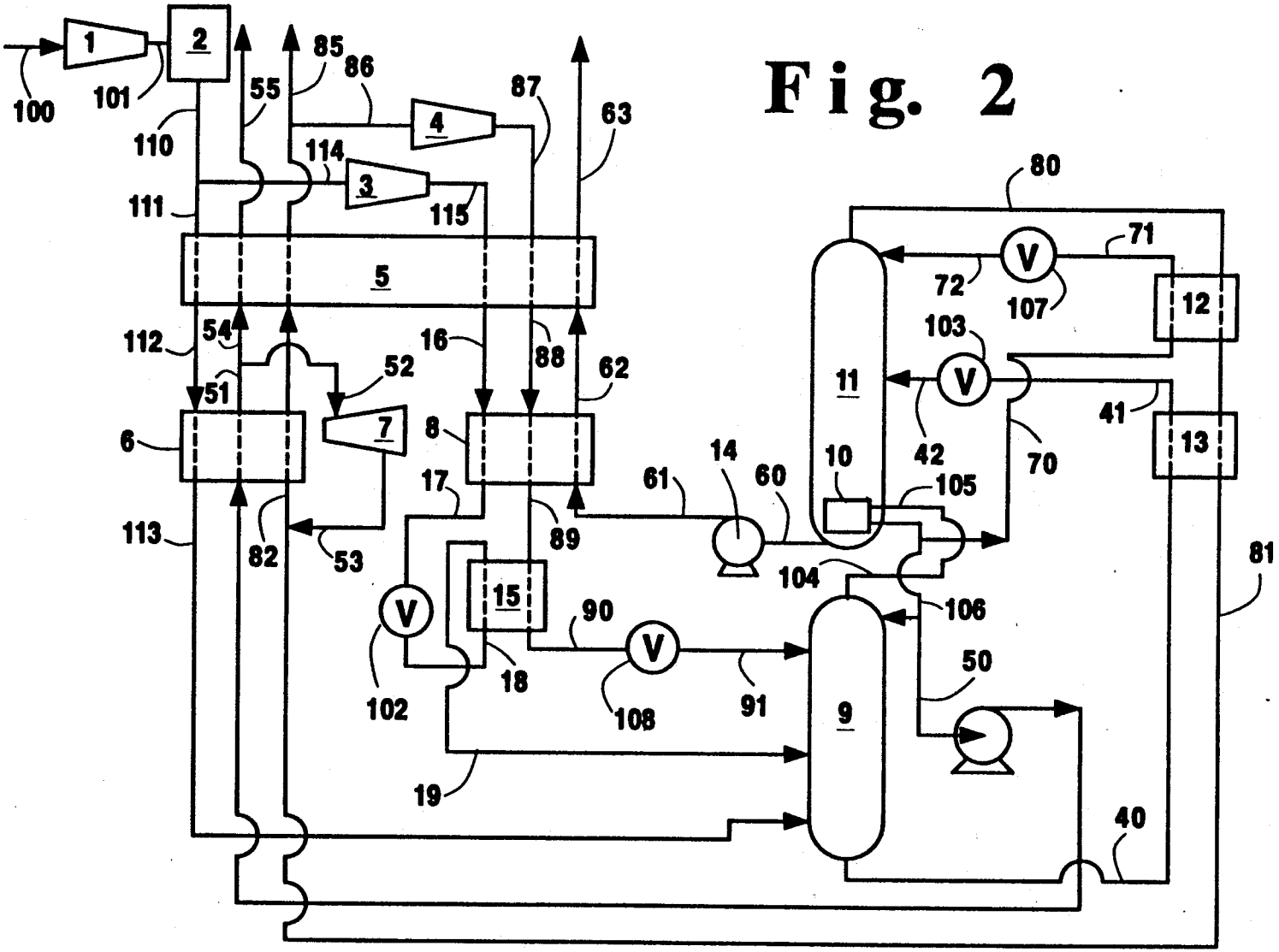
FIG. 2 is a schematic representation of another preferred embodiment of the cryogenic rectification system of the invention.

A stream of first nitrogen-rich fluid is withdrawn from the upper portion of column 9. This stream is shown as stream 50 which is a portion of stream 104. Stream 50 may optionally be withdrawn from main condenser 10, for example as a portion of liquid stream 106, pumped to a higher pressure and transition-warmed through heat-exchanger 6 from which it emerges as stream 51 as illustrated in FIG. 2. As shown in the Figures, nitrogen-rich vapor 50 is warmed by passage through heat exchanger 6 and emerges from heat exchanger 6 as stream 51. In the embodiments illustrated in the Figures, some of vapor stream 51 is passed as stream 52 through nitrogen expander 7 wherein it is expanded to a lower pressure to generate refrigeration. The major portion of stream 51 is passed as stream 54 through heat exchanger 5 and then removed from the system as stream 55 which is recovered as high pressure nitrogen gas having a purity generally of at least 99 percent and preferably of at least 99.9 percent.

In the embodiments illustrated in the Figures, the expanded first nitrogen-rich vapor 53, which is passed out from nitrogen expander 7, is combined with stream 81 to form combined stream 82 which is passed through heat exchangers 6 and 5 as was previously described and out of the system as stream 85. Some of the expanded first nitrogen-rich vapor may also form part of nitrogen stream 86.

Nitrogen-rich vapor stream 86 is compressed through nitrogen compressor 4 to a pressure within the range of from 120 to 3000 psia, preferably within the range of from 140 to 2000 psia, and resulting compressed stream 87 is cooled by passage through heat exchanger 5 to form cooled nitrogen-rich vapor stream 88 which is additionally transition-cooled by passage through heat exchanger 8. Resulting nitrogen-rich fluid 89 is passed into column 9 as additional reflux. In the embodiment illustrated in the Figure, nitrogen-rich fluid 89 is subcooled additionally through subcooler 15 and resulting subcooled stream 90 passed through valve 108 and then as stream 91 into column 9 as reflux.

Oxygen-rich fluid is withdrawn as liquid stream 60 from the lower portion of the lower pressure column and pumped through pump 14 to a pressure within the range of from 40 to 3000 psia, preferably within the range of from 40 to 2000 psia. The resulting oxygen-rich fluid 61 is then passed through heat exchanger 8 wherein it is transition-warmed by indirect heat exchange with transition-cooling elevated pressure feed air and transition-cooling compressed nitrogen-rich fluid which comprises second nitrogen-rich fluid from the second column and may also comprise first nitrogen-rich fluid from the first column. The resulting transition-cooled oxygen-rich fluid 62 is further warmed by passage through heat exchanger 5 and recovered as product high pressure oxygen gas 63 having a purity within the range of from 70 to 99.9 percent, preferably within the range of from 90 to 99.5 percent.

A computer simulation of the invention was carried out using the embodiment of the invention illustrated in the FIG. 1 and the results of this example are presented in Table I wherein the stream numbers correspond to those of the FIG. 1. The example is presented for illustrative purposes and is not intended to be limiting.

TABLE I

| Stream Number | Normalized Molar Flow | Pressure (PSIA) | Temp (°K.) | $N_2$ + Ar Mole % | $O_2$ Mole % |
|---|---|---|---|---|---|
| 10 | 1000 | 224 | 296 | 79.04 | 20.96 |
| 15 | 208 | 560 | 296 | 79.04 | 20.96 |
| 55 | 20 | 216 | 292 | 99.99 | <0.01 |
| 85 | 774 | 71 | 292 | 98.18 | 1.82 |
| 87 | 89 | 670 | 296 | 98.18 | 1.82 |
| 63 | 206 | 250 | 292 | 5.00 | 95.00 |

Now, by the use of the dual heat pump arrangement of this invention wherein high pressure oxygen-rich fluid is transition-warmed against both transition-cooling feed air and transition-cooling nitrogen, one can operate a cryogenic rectification plant at higher than conventional pressures while achieving improved recovery efficiency over conventional plants operating at higher than conventional pressures. Although the invention has been described in detail with reference to a particular preferred embodiment, those skilled in the art will recognize that there are other embodiments of the invention within the spirit and the scope of the claims.

What is claimed is:

1. A cryogenic rectification method for producing high pressure product comprising:

(A) transition-cooling an elevated pressure feed air stream and passing resulting feed air fluid into a high pressure column;

(B) separating feed air in the high pressure column by cryogenic rectification into a first nitrogen-rich fluid and into oxygen-enriched fluid;

(C) passing first nitrogen-rich fluid and oxygen-enriched fluid into a lower pressure column and separating them therein by cryogenic rectification into a second nitrogen-rich fluid and into oxygen-rich fluid;

(D) withdrawing second nitrogen-rich fluid from the lower pressure column, compressing the second nitrogen-rich fluid, transition-cooling the compressed second nitrogen-rich fluid and passing the resulting second nitrogen-rich fluid into the high pressure column; and (E) withdrawing oxygen-rich fluid from the lower pressure column and pumping the oxygen-rich fluid to a higher pressure, transition-warming the pumped oxygen-rich fluid by indirect heat exchange with the transition-cooling elevated pressure feed air and the transition-cooling compressed second nitrogen-rich fluid, and recovering resulting transition-warmed fluid as high pressure product oxygen.

2. The method of claim 1 further comprising warming transition-cooled elevated pressure feed air by indirect heat exchange with transition-cooled compressed second nitrogen-rich fluid to subcool the second nitrogen-rich fluid prior to passing the feed air fluid and the second nitrogen-rich fluid into the high pressure column.

3. The method of claim 1 wherein first nitrogen-rich fluid is withdrawn from the upper portion of the high pressure column and recovered as nitrogen product.

4. The method of claim 3 wherein first nitrogen-rich fluid is liquefied, pumped to a higher pressure and transition-warmed prior to recovery as nitrogen product.

5. The method of claim 1 wherein first nitrogen-rich fluid is withdrawn from the upper portion of the high pressure column, is expanded to generate refrigeration, and is warmed by indirect heat exchange with feed which is then passed into the high pressure column.

6. The method of claim 1 wherein the flowrate of the transition-cooling feed air comprises from 25 to 75 percent of the total transition-cooling fluid flowrate in the heat exchange with transition-warming oxygen-rich fluid.

7. A cryogenic rectification apparatus for producing high pressure product comprising:

(A) a feed air compressor, a heat exchanger, a first column, and means for passing feed air from the feed air compressor to the heat exchanger and from the heat exchanger to the first column;

(B) a second column and means for passing fluid from the first column to the second column;

(C) a nitrogen compressor, means for passing fluid from the second column to the nitrogen compressor, from the nitrogen compressor to the heat exchanger, and from the heat exchanger to the first column;

(D) a pump, means for passing fluid from the second column to the pump and from the pump to the heat exchanger; and (E) means for recovering fluid from the heat exchanger.

8. The apparatus of claim 7 further comprising a subcooler wherein both the means for passing fluid from the feed air compressor to the heat exchanger and to the first column, and the means for passing fluid from the nitrogen compressor to the heat exchanger and to the first column pass through the subcooler.

9. The apparatus of claim 7 further comprising means for withdrawing and recovering fluid from the upper portion of the first column.

* * * * *